US008256180B2

(12) United States Patent
Fink

(10) Patent No.: US 8,256,180 B2
(45) Date of Patent: Sep. 4, 2012

(54) ROOF TILE WITH AT LEAST ONE WATER COURSE DEFINED BY PROJECTIONS

(75) Inventor: Josef Fink, Blindenmarkt (AT)

(73) Assignee: Monier Technical Centre GmbH (DE)

( * ) Notice: Subject to any disclaimer, the term of this patent is extended or adjusted under 35 U.S.C. 154(b) by 397 days.

(21) Appl. No.: 12/089,323

(22) PCT Filed: Aug. 25, 2006

(86) PCT No.: PCT/EP2006/008332

§ 371 (c)(1),
(2), (4) Date: Aug. 15, 2008

(87) PCT Pub. No.: WO2007/045299

PCT Pub. Date: Apr. 26, 2007

(65) Prior Publication Data

US 2009/0151287 A1 Jun. 18, 2009

(30) Foreign Application Priority Data

Oct. 20, 2005 (DE) ..... 10 2005 050 657

(51) Int. Cl.
*E04D 1/00* (2006.01)

(52) U.S. Cl. ..... 52/533; 52/543; 52/748.1; 52/26

(58) Field of Classification Search ..... 52/518, 52/519, 525, 526, 527, 533, 543, 556, 557, 52/747.11, 748.1, 24, 26
See application file for complete search history.

(56) References Cited

U.S. PATENT DOCUMENTS

| | | | | |
|---|---|---|---|---|
| 2,211,508 | A * | 8/1940 | Little | 52/533 |
| 3,606,652 | A | 9/1971 | Hammond | |
| 4,899,514 | A * | 2/1990 | Brookhart, Jr. | 52/553 |
| 5,004,415 | A | 4/1991 | Schulz et al. | |
| 5,048,255 | A * | 9/1991 | Gonzales | 52/533 |
| 5,743,059 | A * | 4/1998 | Fifield | 52/519 |
| 5,941,039 | A * | 8/1999 | Law | 52/540 |
| 7,871,552 | B2 * | 1/2011 | Srostlik et al. | 264/271.1 |

FOREIGN PATENT DOCUMENTS

| | | |
|---|---|---|
| AT | E27 842 | 4/1985 |
| DE | 18 38 431 | 9/1961 |
| DE | 18 12 456 | 8/1969 |

(Continued)

OTHER PUBLICATIONS

English translation of International Preliminary Report on Patentability.

*Primary Examiner* — William Gilbert
*Assistant Examiner* — Chi Q Nguyen
(74) *Attorney, Agent, or Firm* — Ostrolenk Faber LLP

(57) ABSTRACT

A roof tile with a central brim and at least one lateral cover or water beading and a watercourse located between them, in whose region a water stop is disposed. This water stop is partially pressed with its edges in the region of the watercourse, of the central brim and of the lateral beading into the material of the roof tile blank. Such water stop is comprised of a flexurally elastic, thin small plate, and specifically of a material which does not conform to the material of the roof tile.

24 Claims, 4 Drawing Sheets

FOREIGN PATENT DOCUMENTS

| | | |
|---|---|---|
| DE | 17 59 427 | 1/1972 |
| DE | 25 08 551 | 3/1976 |
| DE | 31 38 656 | 4/1983 |
| DE | 35 22 846 | 1/1987 |
| DE | 89 03 375 | 5/1989 |
| EP | 0 137 423 | 4/1985 |
| GB | 664 010 | 1/1952 |
| GB | 1 174 992 | 12/1969 |
| GB | 1514926 | 2/1975 |
| SU | 1673714 | 8/1991 |

* cited by examiner

ROOF TILE WITH AT LEAST ONE WATER COURSE DEFINED BY PROJECTIONS

BACKGROUND

The invention relates to a roof tile, and more particularly a roof tile having a watercourse which includes a water stop.

In the production of roof tiles according to the extrusion method onto a strand or extrusion line of abutting subforms of equal length delivered at constant speed is applied a green concrete layer as an endless band, which is shaped on the top side by forming tools corresponding to the surface contour conventional for roof tiles. The continuously applied green concrete layer is subsequently, by means of a cutting tool developed as a blade, cut at each end of each subform in a cutting station, such that each subform carries a single roof tile blank. The roof tile blank on its subform is subsequently cured in a drying chamber and, after it is cured, is provided with a surface coating. Such a method for the production of roof tiles is described in DE 35 22 846 A1.

In order to roof a pitched roof with such roof tiles to make it tight against driving rain, it is necessary that the roof tiles adjacent in a ridge-to-eaves line are placed such that they overlap. The particular length of overlap is herein dependent on the particular slope of the roof, i.e. in the case of a roof with very steep slope the overlap can be less than in the case of a roof with very low slope.

Construction measures have, however, been taken in which the roof tile is provided on its underside at the foot-end margin with foot ribs extending transversely. The subforms known from DE 35 22 846 A1 are, for example, equipped at their transverse margins with recesses, such that the green concrete pressed into these recesses forms suspension flanges at the head-end margin of the roof tile blank, and, at the foot-end margin, forms foot ribs extending transversely. In this way during the roofing the ridge-end roof tile can be hooked with its suspension flanges onto a roof batten and with its foot ribs be placed onto the surface of the roof tile adjacent in the direction of the eaves. Due to the foot ribs, in the region of overlap of the roof tiles a type of labyrinth is therein formed which counteracts the rain water from being driven into the roof.

However, the use of these roof tiles is problematic in the case of roofs having a slope of less than 22°, since, due to the low slope of the roof, a very large overlap length of the roof tiles is required. Between ridge and eaves, consequently, a very large number of parallel roof tile rows must be emplaced. Due to such large requirement of roof tiles and the preparation of a roof batten construction adapted to the number of roof tiles, the material and labor costs are considerably increased. Buildings with very low roof slopes are therefore frequently roofed with large-format, less expensive and lighter roofing materials, such as for example sheet metal or fiber-cement slabs.

A change has therefore taken place toward providing the roof tiles with a water stop on their top side in the region of their head-end margin, which stop prevents heavy rain from being driven into the root. In this way the overlapping of the roof tiles can be markedly decreased, such that the material and labor costs are reduced.

DE 18 12 456 A1 and DE 25 08 551 A1 describe methods suitable for providing the roof tile blanks resting on their subforms with a water stop. In both methods, from a green concrete provided separately, first, a water stop is formed which subsequently is pressed or adhered onto the top side of the roof tile blank in the region of the head-end margin. The water stop is therein implemented relatively wide in order to ensure, on the one hand, sufficient dimensional stability and, on the other hand, a material closure connection over a large area.

However, the roof tiles equipped according to the above methods with a water stop have the disadvantage that, due to the use of different green concretes, between the roof tile and the water stop a weakening joint site is formed, which is susceptible to impact and tends to the development of cracks.

To eliminate this shortcoming, a change was proposed according to GB 664010 toward forming onto the head-end margin of the roof tile blank the water stop during the cutting of the green concrete strand into individual roof tile blanks. Roof tile blank and water stop are therefore comprised of the same green concrete. In this way a good connection between water stop and roof tile can be attained.

To ensure stackability and packagability of the roof tiles, the suspension flanges on the underside of the roof tile located at the top in the stack must, however, be disposed very far apart from the head-end margin of the roof tile, in order to make available sufficient space for the water stop, disposed on the top side and directly at the head-end margin of the subjacent roof tile in the stack.

If the roof tile provided according to GB 664010 with a water stop is compared with the roof tiles depicted in DE 35 22 846, FIGS. 6 and 7, in which the suspension flanges are disposed optimally directly at the head-end margin of the roof tile, it becomes apparent that the roof tiles disclosed in GB 664010, due to the large distance of the suspension flanges from the head-end margin of the roof tile, have a markedly reduced cover length. A large number of parallel roof tile rows is consequently still required.

Considered from production-related aspects, it is, moreover, of disadvantage that for the production of roof tiles with a water stop according to GB 664010 a separate set of subforms is required, since the position of the suspension flanges deviates from the position optimal in conventional roof tiles.

SUMMARY

The invention therefore addresses the problem of making available a roof tile provided with a water stop which can be produced on conventional subforms, which can bring to bear its full cover length even in roofs with very low roof slope and which ensures reliable and permanent securement of the water stop in place.

This problem is solved with a water stop comprising a flexurally elastic plate.

The invention consequently relates to a roof tile, which, for example, comprises a central brim and at least one lateral cover or water beading with a watercourse disposed between them, in the region of which a water stop is located. The water stop is partially pressed with its edges into the material of the roof tile blank in the region of the watercourse, of the central brim and of the lateral beading. It is comprised of a flexurally elastic thin small plate, and specifically of a material which does not conform to the material of the roof tile.

The advantage attained with the invention comprises in particular that the water stop is held mechanically by the cured concrete encompassing it. In this way the detachment of the water stop from the roof tile—as often occurs, due to the joint site, in the case of the water stops according to DE 18 12 456 A1 and DE 25 08 551 A1 in the packaging and placement of the roof tiles—is avoided.

Since the water stop, furthermore, can be pressed into the green concrete at a freely selectable distance from the head-end margin of the roof tile blank, the suspension flanges on the underside of the roof tile blank can continue to remain in their optimal position directly at the head-end margin, such that conventional subforms can be utilized. Apart from a reduction of the cover length of the roof tiles, the high investment costs for a separate set of subforms become thereby superfluous compared to the roof tile disclosed in GB 664010.

The distance of the water stop from, the head-end margin of the roof tile blank depends on the design model of the roof tile and the suspension flange. In order for the water stop not to present a hindrance in the stacking of the roof tiles, the distance should be at least 10 mm, preferably, however, 25 mm.

Compared to the relatively wide water stops produced of concrete according to DE 18 12 456 A1 and DE 25 08 551 A1 (cf. also DE 17 59 427 A, DE 1 838 431 U, AT 27 842 E), a gain of cover length results if the water stop is developed in the form of small plates. Simultaneously, the insertion of the water stop into the compacted green concrete is facilitated. In order to have satisfactory rigidity, the material thickness of the water stop has be at least 0.25 mm, however preferably 1 mm.

For the penetration of the water stop into the green concrete it may be advantageous if the edges of the sides of the water stop penetrating into the green concrete are developed in the form of a wedge in the insertion direction.

In order to fit the water stop optimally into the region of the watercourse, of the lateral beading and of the central brim, the geometry of the water stop is matched to the cross sectional profile of the roof tile blank.

For roof tiles with a planar watercourse, the water stop is preferably developed as an isosceles trapezoid, such that the long side (base of the trapezoid) of the inserted water stop is exposed while the remaining sides are each inserted into the concrete in the proximity of the watercourse, of the central brim and of the lateral beading. With a trapezoidal water stop the particular angle formed by the base and the sides should be in the range between 40 and 70 degrees. The angle is preferably 57 degrees.

In contrast, water stops developed like segments of a circle or like sickles are suitable for roof tiles with concavely shaped watercourses.

In order to prevent, in the region of the lateral beading and the central brim, rain water driven into the overlap region from circumventing the water stop, the water stop can be implemented such that it is higher in the region of its ends flanking here than in the region of the watercourse.

Circumventing the water stop can additionally be made more difficult if, at least in the region of the central brim, a drainage channel disposed in front of the water stop is provided, which diverts rain water escaping at the water stop back into the watercourse of the roof tile.

To attain the secure fixing of the water stop, it should penetrate at least to a depth of 0.5 mm, preferably however of 3 mm, into the green concrete in the region of the watercourse, the central brim and the lateral beading.

Embedding the water stop into the green concrete can be improved if the water stop includes anchoring elements at its edges penetrating into the green concrete.

The anchoring elements can be developed in the form of horns or hooks. In comparison to the other edges of the water stop, the anchoring elements can project markedly deeper into the green concrete. Thus the anchoring elements, for example, may penetrate to a depth of 5.5 mm, while the other edges of the water stop penetrate to a depth of only 3 mm.

The water stop is produced of corrosion-resistant or at least corrosion-protected material. Since the material of the water stop also undergoes temperature fluctuations, its coefficient of longitudinal thermal expansion should approach that of the concrete in order not to destroy the encompassing concrete. Preferred materials for the water stop are synthetic materials, aluminum alloys, steel coated with zinc, or stainless steel.

To protect the roof tile permanently against adhesion of dirt and growth of algae, the roof tile provided with a water stop is provided with a surface coating, for example with a polymer dispersion paint. Herein not only the water stop and the roof tile are colored uniformly, such that material differences are no longer apparent, but the surface coating simultaneously seals possible gaps between the water stop and the roof tile.

BRIEF DESCRIPTION OF THE DRAWINGS

Embodiment examples of the invention are shown in the drawing and will be described in the following in further detail. In the drawing depict.

DETAILED DESCRIPTION

Figure 1:
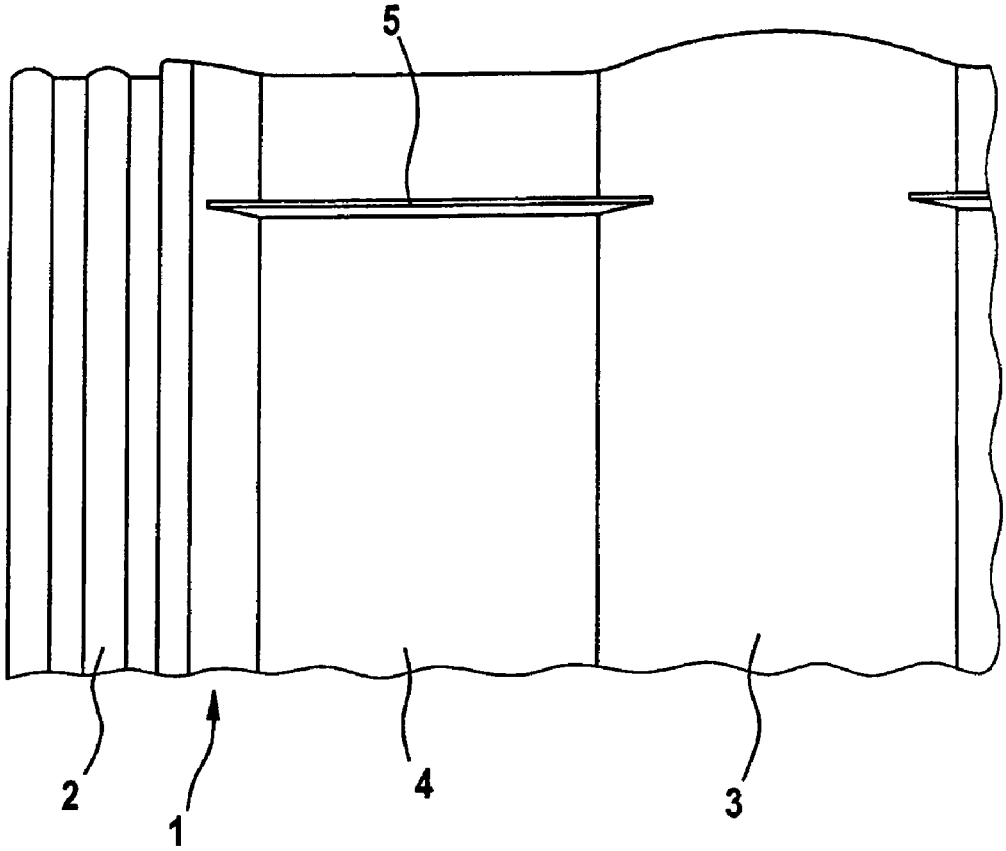
FIG. 1 a top view onto a subregion of a roof tile according to the invention, FIG. 2 a cross section through a roof tile with a first water stop.

FIG. 1 shows a portion of a roof tile 1 in top view. This roof tile 1 comprises a lateral water beading 2 as well as a central brim 3. Between the water beading 2 and the brim 3 is located a watercourse 4. In this watercourse 4 is located a water stop 5 which is comprised of a thin and elastic metal or synthetic part. This water stop 5 is partially pressed with its edges in the region of the watercourse 4, of the central brim 3 and of the lateral beading 2 into the compacted, yet still green, concrete of the roof tile 1. After the roof tile 1 has been cured, the water stop 5 is seated fixedly in the roof tile 1.

Figure 2:
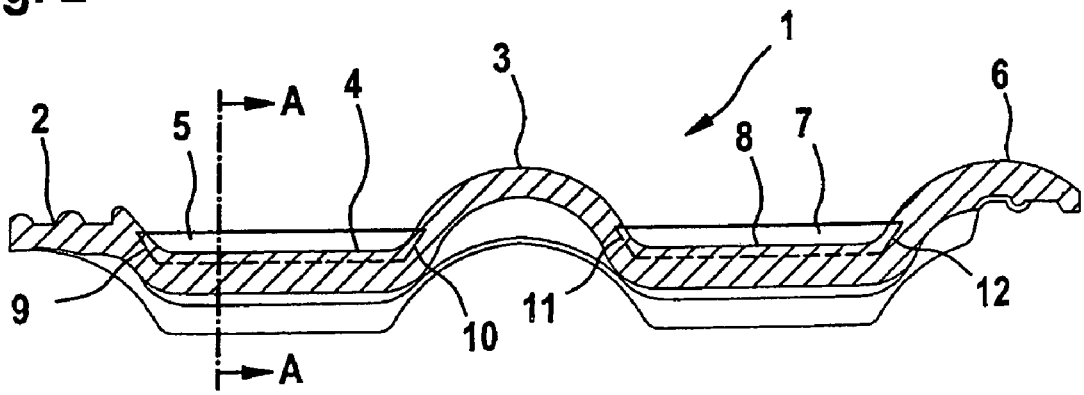

FIG. 2 shows a cross section through roof tile 1 in which now the lateral cover beading 6 can also be seen. Between the cover beading 6 and the central brim 3 is located a further water stop 7 which is also implemented as a thin and elastic small plate.

The water stops 5 and 7 have the form of a trapezoid, wherein the short sides of the trapezoid are pressed into the watercourses 4, 8. The oblique lateral edges 9, 10; 11, 12 of the water stops 5, 7 engage into the water beading 2 or the cover beading 6 and into the central brim 3. The long sides of the trapezoids are substantially exposed. Through the trapezoidal formation of the water stops 5, 7 their penetration into the green concrete is facilitated.

It is understood that the water stops are matched to the particular profile of the roof tile blanks.

Figure 3:
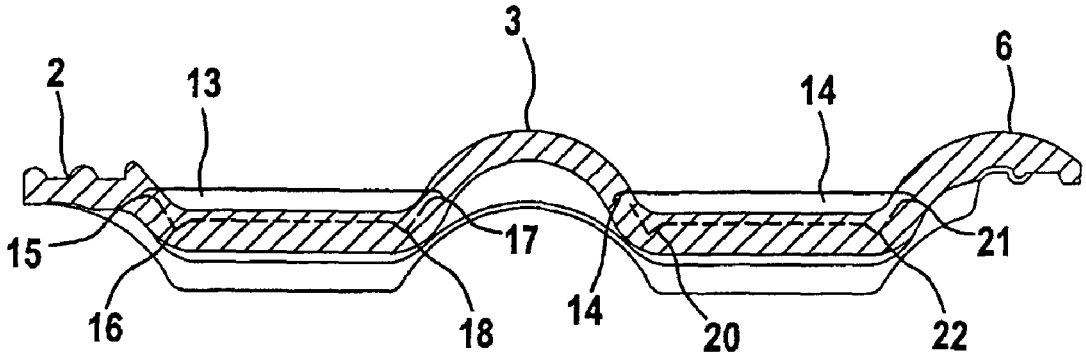
FIG. 3 a cross section through a roof tile with a second water stop.

In FIG. 3 two water stops 13, 14 are depicted, which differ from the water stops 5, 7 of FIG. 2 thereby that they have hooks 15 to 18 and 19 to 22, respectively, at the corners of the trapezoid. These hooks 15 to 22 serve as anchorages in the green concrete.

Figure 4:
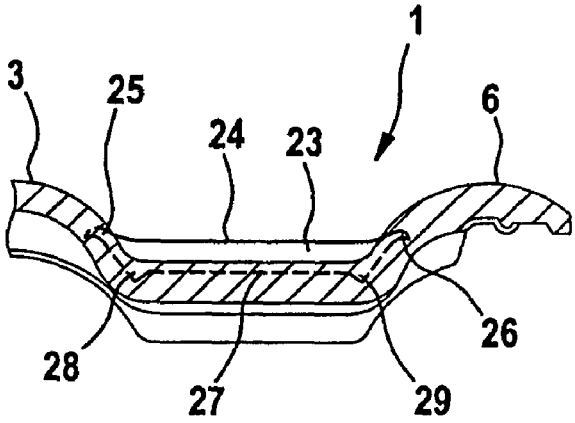
FIG. 4 a cross section through a roof tile with a third water stop.

FIG. 4 shows a further variant of a water stop 23, in which the long side 24 of the trapezoid is directed upwardly at the ends. Hereby two heightened hook-form anchorages 25, 26 are formed.

The ends of the lower side 27 of the trapezoid are provided with horn-shaped anchoring elements 28, 29. Only the right half of roof tile 1 is shown in FIG. 4.

The water stops are preferably produced of a corrosion-resistant or corrosion-protected material. Suitable materials are weather-proof synthetic materials or metals, for example, aluminum or copper.

Figure 5:
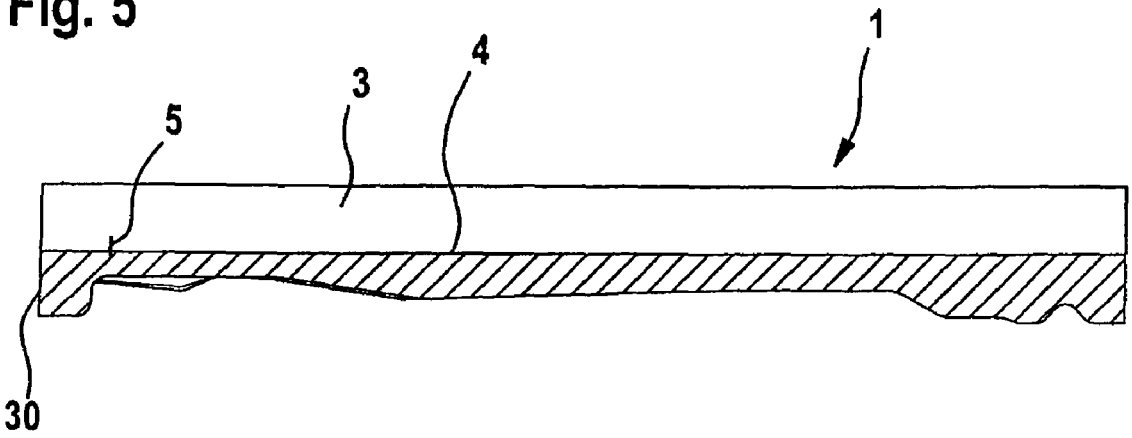
FIG. 5 a longitudinal section through the roof tile according to FIG. 2, FIG. 6 a cross section through a roof tile according to FIG. 2, comprising a water stop developed as a segment of a circle, and FIG. 7 a cross section through a roof tile according to FIG. 2, comprising a water stop developed as a segment of a sickle shape.

FIG. 5 shows a longitudinal section A-A through the roof tile 1 according to FIG. 2. Evident are herein the water stop 5, the central brim 3 and the watercourse 4. The water stop 5 is here spaced at least 10 mm apart from the edge 30 of the roof tile 1. After the roof tile 1 has been placed, this edge 30 is oriented in the direction of the ridge. The edge 30 is thus a portion of a suspension flange.

The roof tile shown in FIGS. 1 to 5 comprises a substantially planar watercourse 4. Suitable water stops for this watercourse 4 are developed in the form of a trapezoid.

Figure 6:
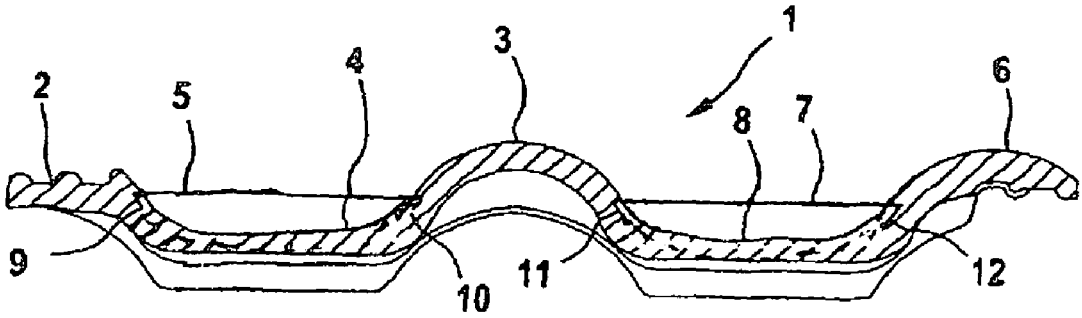
Figure 7:
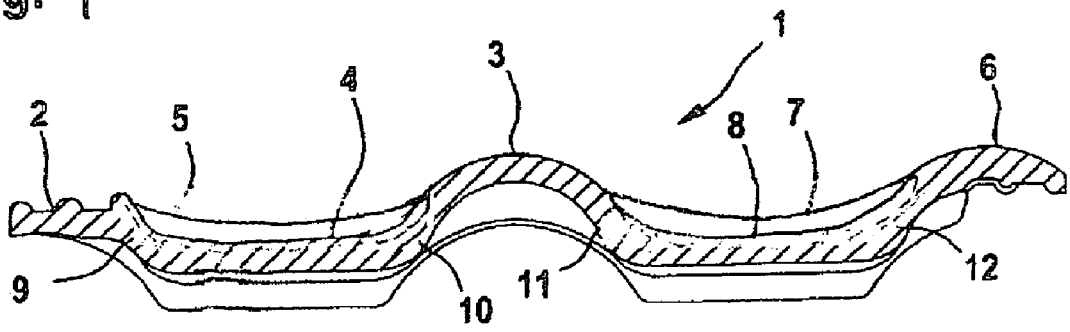

If, in contrast, the watercourse 4, 8 is shaped concavely, the water stops 5, 7 are preferably developed as segments of a circle (FIG. 6) or as sickles (FIG. 7).

The invention claimed is:

1. A concrete roof tile comprising: at least one watercourse formed in said concrete roof tile, said watercourse being delimited by elevations formed in said roof tile; and a water stop formed of a flexurally elastic plate separate from said roof tile, secured within said watercourse by anchoring portions of said plate, said anchoring portions being penetrated into a bottom of said watercourse and into walls of said elevations, said anchoring portion being formed at margin regions of said flexurally elastic plate.

2. The concrete roof tile as claimed in claim 1, wherein the water stop is comprised of a metal or a metal alloy.

3. The concrete roof tile as claimed in claim 1, wherein the water stop is comprised of a synthetic material.

4. The concrete roof tile as claimed in claim 1, wherein the water stop has a thickness of less than 3 mm.

5. The concrete roof tile as claimed in claim 1, wherein a coefficient of thermal expansion of the water stop approaches a coefficient of thermal expansion of the roof tile.

6. The concrete roof tile as claimed in claim 1, wherein the water stop has a thickness of more than 0.25 mm.

7. The concrete roof tile as claimed in claim 1, wherein the water stop has a thickness of approximately 1 mm.

8. The concrete roof tile as claimed in claim 1, wherein the water stop is developed in the form of a wedge at its lateral margins.

9. The concrete roof tile as claimed in claim 1, wherein the water stop is developed in the form of a trapezoid.

10. The concrete roof tile as claimed in claim 9, wherein the short side of the trapezoid and the lateral sides of the trapezoid are pressed into the roof tile, while the long side of the trapezoid is substantially exposed.

11. The concrete roof tile as claimed in claim 10, wherein the long side of the trapezoid is higher at its ends than in the center.

12. The concrete roof tile as claimed in claim 9, wherein the angle between the long side of the trapezoid and the lateral sides is between 40 and 70 degrees.

13. The concrete roof tile as claimed in claim 9, wherein the angle between the long side of the trapezoid and the lateral sides is approximately 57 degrees.

14. The concrete roof tile as claimed in claim 9, wherein said anchoring portions of said plate further include anchoring elements, wherein the anchoring elements are provided at corners of the trapezoid.

15. The concrete roof tile as claimed in claim 1, wherein the water stop is developed in the form of a segment of a circle.

16. The concrete roof tile as claimed in claim 1, wherein the water stop is developed in the form of a sickle.

17. The concrete roof tile as claimed in claim 1, wherein said anchoring portions of said plate further includes anchoring elements.

18. The concrete roof tile as claimed in 1, wherein said anchoring portions of said plate further include anchoring elements, wherein the anchoring elements are developed in the form of hooks.

19. The concrete roof tile as claimed in claim 1, wherein one of the elevations delimiting the watercourse is a central brim.

20. The concrete roof tile as claimed in claim 19, wherein the central brim includes a drainage channel disposed in front of the water stop.

21. The concrete roof tile as claimed in claim 1, wherein further elevations delimiting the watercourse are lateral cover or water beadings.

22. The concrete roof tile as claimed in claim 1, wherein the water stop is disposed at a distance of at least 10 mm from a ridge-end edge of the roof tile.

23. The concrete roof tile as claimed in claim 22, wherein the water stop is disposed at a distance of 25 mm from the ridge-end edge of the roof tile.

24. The concrete roof tile as claimed in claim 1, wherein said plate penetrates at least 0.5 mm into the roof tile.

* * * * *